US010278528B1

(12) United States Patent
Godsby

(10) Patent No.: US 10,278,528 B1
(45) Date of Patent: May 7, 2019

(54) BALL CAP HOLDER

(71) Applicant: Jimmy Godsby, Wasilla, AK (US)

(72) Inventor: Jimmy Godsby, Wasilla, AK (US)

( * ) Notice: Subject to any disclaimer, the term of this patent is extended or adjusted under 35 U.S.C. 154(b) by 0 days.

(21) Appl. No.: 16/207,623

(22) Filed: Dec. 3, 2018

Related U.S. Application Data

(60) Provisional application No. 62/760,103, filed on Mar. 15, 2018.

(51) Int. Cl.
*A47G 25/10* (2006.01)
*A47F 7/00* (2006.01)
*A47F 7/06* (2006.01)

(52) U.S. Cl.
CPC ..... *A47G 25/10* (2013.01); *A47F 7/0007* (2013.01); *A47F 7/06* (2013.01)

(58) Field of Classification Search
CPC ..... A47G 25/10; A47F 7/06; A47F 7/007
USPC .... 211/30–33, 85.3, 85.7, 14, 49.1; 206/8, 9
See application file for complete search history.

(56) References Cited

U.S. PATENT DOCUMENTS 301,916 A * 7/1884 O'Neil ..... B65B 67/12 248/97
406,673 A * 7/1889 Seymour ..... A45C 11/02 206/9
930,420 A * 8/1909 Seward ..... A45C 11/02 206/8
946,833 A * 1/1910 Bake ..... A47G 25/0685 211/32
958,070 A * 5/1910 Aubuchon ..... A45C 11/02 206/8
995,982 A * 6/1911 Moore ..... F16B 2/246 211/33
1,001,831 A * 8/1911 Fisher ..... A45C 11/02 206/8
1,083,491 A * 1/1914 Herzberg ..... E05B 69/006 211/32
1,236,697 A * 8/1917 Fechner ..... A45C 11/02 206/8
1,445,743 A * 2/1923 Booth ..... A45C 11/02 206/9
1,572,973 A * 2/1926 Tait ..... A47G 25/10 211/32
1,627,652 A * 5/1927 Kornicker ..... A47F 7/00 211/33
1,784,333 A * 12/1930 Bruer ..... A45C 11/02 206/8
1,804,931 A * 5/1931 Hoban ..... A42C 3/04 211/33
1,926,201 A * 9/1933 Kahns ..... A47G 25/0607 211/31
1,969,799 A * 8/1934 Johnston ..... A47F 7/06 206/8

(Continued)

*Primary Examiner* — Jonathan Liu
*Assistant Examiner* — Devin K Barnett
(74) *Attorney, Agent, or Firm* — Michael J. Tavella

(57) ABSTRACT

A storage frame for ball caps. It is a form that has a flat base that is formed into the general shape of a large ball cap. Spines extends upward from the base in a semi-circular form around the back of the base. A semi-circular form holds the rear spines, and provides a finished look to the device. On the base, flexible pieces of plastic make a smaller form, in the shape of a ball cap. This lower form is used to hold the caps, which can be stacked up as desired. The rear four pieces are secured at the tops of the bowed pieces with a screw and nut.

5 Claims, 4 Drawing Sheets

(56) References Cited

U.S. PATENT DOCUMENTS 2,070,417 A * 2/1937 Whenham ..... A47G 25/02 211/180
2,094,810 A * 10/1937 Oppenheimer ..... A47F 7/06 211/166
2,137,737 A * 11/1938 Wenzel ..... B25B 5/14 206/303
2,198,037 A * 4/1940 Jarnagin ..... A45C 11/02 206/9
2,225,483 A * 12/1940 Payne ..... A45C 11/02 206/8
2,257,057 A * 9/1941 Huye ..... A45C 11/02 206/9
D141,951 S * 8/1945 Smith ..... 206/315.1
D150,414 S * 8/1948 Gulley ..... 211/14
2,544,053 A * 3/1951 Sharaf ..... A47J 47/16 126/266
2,595,722 A * 5/1952 Sorensen ..... A47F 7/06 211/30
3,036,698 A * 5/1962 Gronemeyer ..... B65D 5/5088 206/8
3,168,229 A * 2/1965 Heifetz ..... A47G 19/08 211/41.2
3,497,118 A * 2/1970 Najjar ..... A63B 47/00 224/196
3,525,440 A * 8/1970 Anderson ..... A47F 7/0028 211/14
3,580,436 A * 5/1971 Di Luco ..... A45D 44/14 206/8
3,603,489 A * 9/1971 Fleisher ..... A45D 44/14 211/30
3,856,472 A * 12/1974 Schweitzer ..... C30B 31/14 148/DIG. 113
4,294,364 A * 10/1981 Bilbrey ..... F24B 15/00 211/182
4,919,278 A * 4/1990 Howen ..... A47J 47/16 206/515
4,978,012 A * 12/1990 Meyers ..... B65D 71/00 206/342
4,993,557 A * 2/1991 Davis ..... A47F 7/06 211/30
5,553,707 A * 9/1996 Lion ..... A45F 5/00 206/315.9
D390,726 S * 2/1998 Arvans ..... D7/704
D399,671 S * 10/1998 Arvans ..... D7/601
6,109,457 A * 8/2000 Dahnke ..... A47G 25/1464 211/32
6,119,873 A * 9/2000 Matthews ..... A47F 7/0007 211/196
6,125,997 A * 10/2000 Campbell ..... A45C 11/02 206/278
6,230,904 B1 * 5/2001 Licari ..... A47F 7/0007 206/497
D457,025 S * 5/2002 Davy ..... D6/515
6,578,716 B1 * 6/2003 Wei ..... A47F 7/06 206/9
7,377,396 B2 * 5/2008 Keen ..... A47F 13/00 211/49.1
7,665,616 B1 * 2/2010 Hobbie ..... A47F 7/06 211/31
8,167,448 B1 * 5/2012 Borrows ..... A42B 1/002 362/106
8,220,673 B1 * 7/2012 Levin ..... D06F 95/008 206/8
8,701,954 B1 * 4/2014 Weinmeister ..... B60R 7/10 206/8
9,210,998 B2 * 12/2015 Kadosh ..... A47B 13/088
10,159,321 B1 * 12/2018 Gooden ..... A45C 11/02
2002/0130094 A1 * 9/2002 Keen ..... A47F 13/00 211/49.1
2004/0251221 A1 * 12/2004 Aiken ..... A47F 7/06 211/30
2005/0098514 A1 * 5/2005 Ohlmann ..... A47F 1/123 211/49.1
2007/0039903 A1 * 2/2007 Aiken ..... A47F 7/06 211/30
2010/0219214 A1 * 9/2010 Pullum ..... A47F 7/06 223/84
2016/0262560 A1 * 9/2016 Fields ..... A47G 25/10
2017/0367464 A1 * 12/2017 Drain ..... A47F 7/06

* cited by examiner

BALL CAP HOLDER

CROSS REFERENCE TO RELATED APPLICATIONS

This application claims benefit of Provisional application 62/760,103 filed March, 2018.

STATEMENT REGARDING FEDERALLY SPONSORED RESEARCH AND DEVELOPMENT

Not Applicable

BACKGROUND OF THE INVENTION

1. Field of the Invention

This invention relates to cap holders and particularly to ball cap holders.

2. Description of the Prior Art

Baseball caps have been a popular style of hat for many years. These caps have a crown that allows different types of logos, sayings or ads to be placed on them. As a result, many people like to collect these hats. The problem of dealing with these hats is where to store them. Many devices have been developed that store hats so that the can be displayed so that the sayings or logos are visible. Such displays tend to take up a lot of space-especially for large hat collections. For those who simply want to store them, it is possible to fold the back of the crown inside the hat, which allows a lot of hats to be nested. This, of course, is not the best way to maintain a nice crown on the hat. Thus, there is a need for a simple way to store hats that does not take up a lot of space, that maintains the shape of the hats and that can be displayed in a room, or stored in a closet.

BRIEF DESCRIPTION OF THE INVENTION

The instant invention solves that problem by providing a storage frame for ball caps. It is a form that has a flat base that is formed into the general shape of the base of a large ball cap. A series of spines extends upwards from the base in a semi-circular form around the back of the base, similar to a Windsor chair. The tops of the spines are held in a semi-circular form that not only holds the rear spines, but also provides a finished look to the top of the device.

On the base, a smaller form in the shape of a ball cap is made up of flexible pieces of plastic. Three of the pieces make up the sides of the crown of a ball cap, being slightly smaller than a standard size cap. A fourth piece runs from the back of the base to the front of the crown shape. The front of this piece has a bowed piece just in front of it that sits just behind the brim of the cap when a cap is in place. This front piece is not attached to the others. The rear four pieces are secured at the tops of the bowed pieces with a screw and nut. All of the flexible pieces are glued into holes formed in the base. Ball caps can then be stacked up on this lower from as desired. The rear spines provide stability for the stacked hats as well as an aesthetic detail.

DETAILED DESCRIPTION OF THE INVENTION

Figure 1:
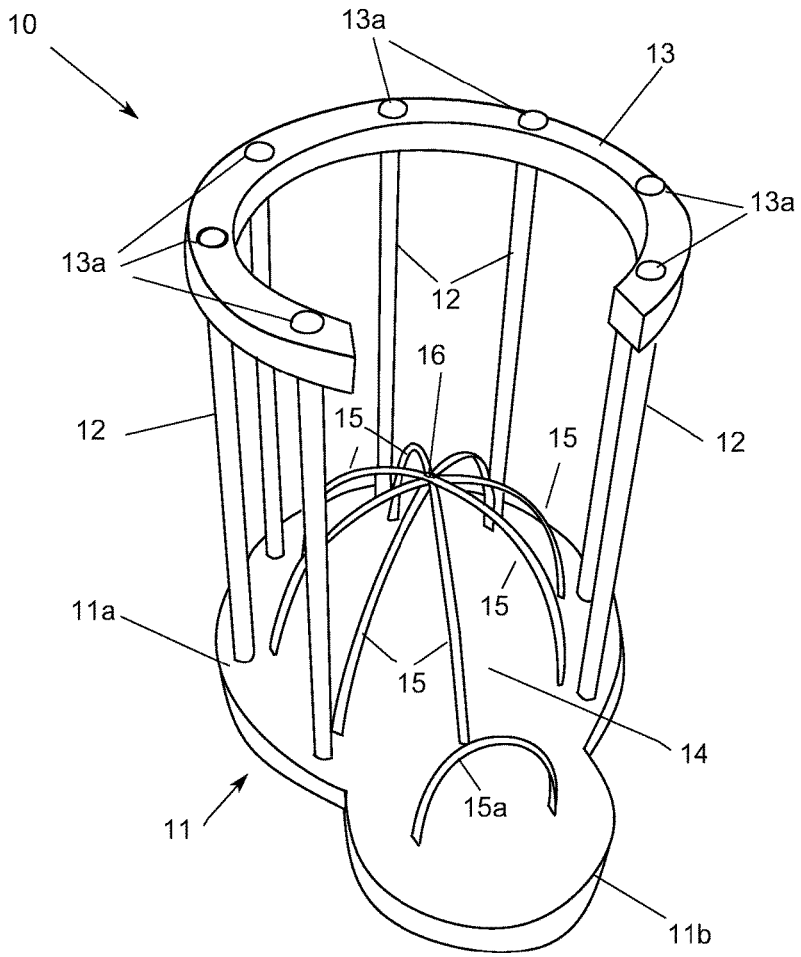
FIG. 1 is a left front perspective view of the invention.
Figure 2:
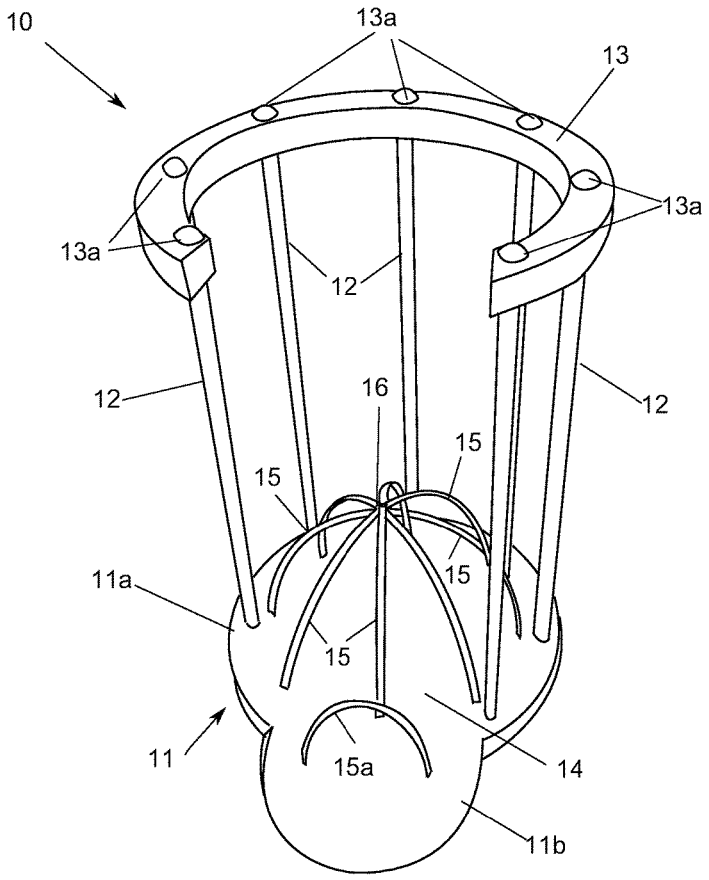
FIG. 2 is a right front perspective view of the invention.

Referring now to the drawings, FIG. 1 is a left front perspective view of the invention 10. FIG. 2 is a right front perspective view of the invention. As shown, the invention 10 has a base 11 that is made up of a single piece that has a large semi-circular form 11*a* in the rear and a smaller semi-circular form 11*b* in the front. This figure approximates the shape of a baseball cap. At the rear portion of the large semi-circular form 11*a*, is a series of spokes 12. These spokes extend upwards at a slight outward angle to vertical. The size of this angle is not overly important, except that it be close to vertical and that it places the spokes so that the tops are wider in diameter than their bottom. This outward angle allows caps to be stacked up, as discussed below, without being squeezed into the device. This effect is clearly shown in FIGS. 1-2. At the top of the spokes 12 is a top ring 13. Note that the top ring 13 is open at the front as shown. This allows for a user to place the caps into the device and to remove them. The spokes are placed into holes drilled into the top ring. If the holes are drilled completely through the top ring, plugs 13*a* are used to fill the holes and leave a pleasing appearance. It is possible to drill blind holes in the bottom of the ring; however, this is more difficult and time consuming. The resulting structure forms a frame around which the hats can be placed (see, e. g, FIG. 4 below). To ensure the hats stay in place and maintain their form, an inner hat form 14 is used. The form 14 consists of four hoops 15 of plastic that are bent as shown in FIGS. 1 and 2. These hoops are placed in holes cut into the base 11 and are secured with glue. The tops of the hoops are secured at the point 16 with a number 4 bolt and nut 16*a* and 16*b*. See, FIG. 3 for a detail view. In addition, an outer hoop 15*a* is secured to the base in the same manner as the inner hat form 14. This outer hoop is positioned in front of the inner hat form and is perpendicular to the front hoop portion, and to the longitudinal axis of the base, as shown. The outer hoop is used to support the brim when a hat is placed in the device.

Figure 3:
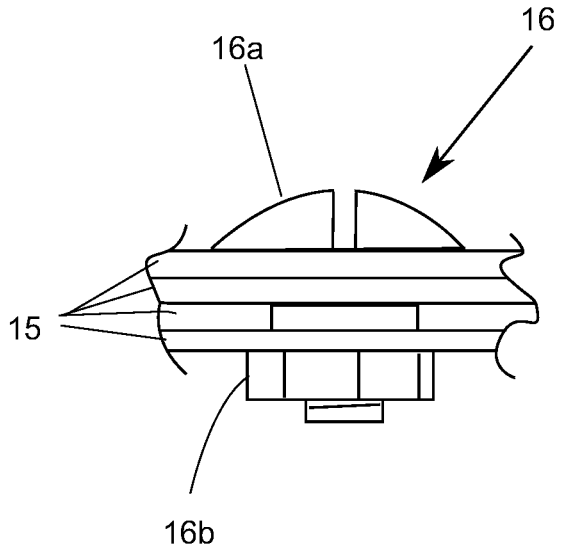
FIG. 3 is an enlarged detail of the screw and nut that secures the four plastic hoops.

FIG. 3 is an enlarged detail of the screw and nut that secures the four plastic hoops. In this view, the bolt 16*a* and nut 16*b* are shown securing the plastic hoops 15.

Figure 4:
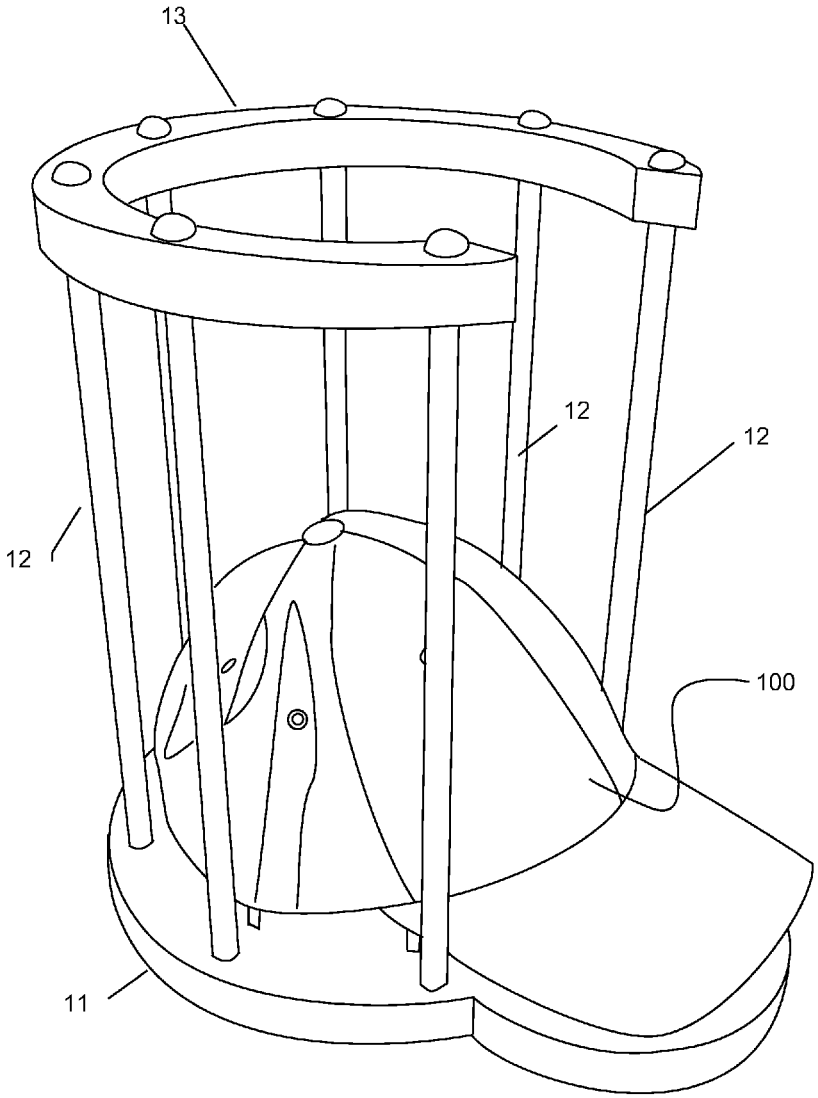
FIG. 4 is a left side perspective view of the invention with a hat installed.

FIG. 4 is a left side perspective view of the invention with a hat installed. As shown. A cap 100 is placed in the holder. The crown of the cap fits over the inner hat form 14 and the brim rests on the smaller semi-circular form 11*b* in the front. Additional caps can be stacked over the cap 100 to safely and neatly store caps using the device.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A hat holder comprising:

a) a continuous planar base having a perimeter and a shape having a first semi-circular section at a rear of the base and a second semi-circular section at a front of the base, wherein the first semi-circular section is larger than the second semi-circular section;

b) a plurality of spokes each having a top and a bottom, wherein the spokes extend upwardly from the rear of said base and forms a semi-circular pattern about the perimeter of the rear of said base;

c) a semi-circular shaped top ring, wherein the top ring has an opening at a front portion of the top ring, said top ring being attached to the tops of said plurality of spokes; and d) an inner hat form attached to said base and being positioned between corresponding pairs of spokes from said plurality of spokes; wherein the inner hat form is configured to hold a plurality of stacked hats thereon;

wherein the inner hat form comprises:

i) a plurality of first inverted U-shaped hoops, wherein each of the first inverted U-shaped hoops have a top portion and a pair of opposed end portions, wherein the end portions of the first inverted U-shaped hoops are radially spaced apart and fixed to the base, wherein the top portions of the first inverted U-shaped hoops are connected to each other in an overlapping manner;

ii) a second inverted U-shaped hoop, wherein the second inverted U-shaped hoop is fixed to the second semi-circular section and spaced from the plurality of first inverted U-shaped hoops; wherein the second inverted U-shaped hoop is smaller than each of the first inverted U-shaped hoops.

2. The hat holder of claim 1, wherein the shape of the base corresponds to a shape of the hats.

3. The hat holder of claim 1, wherein the plurality of spokes each extends upwards from said base at a slightly outward angle.

4. The hat holder of claim 3, wherein the tops of said plurality of spokes form a first arc that has a first diameter and the bottoms of said plurality of spokes form a second arc that has a second diameter, wherein the first diameter is larger than the second diameter.

5. The hat holder of claim 1, wherein the plurality of first inverted U-shaped hoops are each made of plastic, wherein the end portions of each first inverted U-shaped hoop are inserted in holes in the base respectively, wherein a fastener secures the top portions of each first inverted U-shaped hoop together.

* * * * *